United States Patent [19]

Schantz

[11] 4,391,071

[45] Jul. 5, 1983

[54] BASEMENT WATER DRAIN COVE

[75] Inventor: Socrates J. Schantz, Marine, Ill.

[73] Assignee: Schantz & Sons, Inc., Marine, Ill.

[21] Appl. No.: 181,986

[22] Filed: Aug. 28, 1980

[51] Int. Cl.[3] ..... E04B 1/70; E04F 17/00; E02D 31/02

[52] U.S. Cl. ..... 52/169.5; 52/287; 137/362

[58] Field of Search ..... 52/169.5, 169.14, 242, 52/287, 716; 137/362

[56] References Cited

U.S. PATENT DOCUMENTS

| | | | |
|---|---|---|---|
| 2,703,002 | 3/1955 | Suskind | 52/242 X |
| 3,283,460 | 11/1966 | Patrick | 52/287 X |
| 3,332,185 | 7/1967 | Adams . | |
| 3,344,569 | 10/1967 | Cotten | 52/287 |
| 3,850,193 | 11/1974 | Guzzo . | |
| 3,975,467 | 8/1976 | Beck . | |
| 3,990,469 | 11/1976 | Ralston . | |
| 4,075,800 | 2/1978 | Molick . | |
| 4,185,429 | 1/1980 | Mendola . | |
| 4,198,794 | 4/1980 | Younts, Jr. . | |

*Primary Examiner*—Alfred C. Perham
*Attorney, Agent, or Firm*—Glenn K. Robbins

[57] ABSTRACT

A drain cove for draining moisture from basement walls along a channel or gutter at the floor junction. The drain cove is comprised of a base member sealed to the floor and extending along the wall and a cove member extending upwardly from the base and having a downwardly directed portion bearing loosely against the wall to form a gutter which permits water collected therein to drain between the cove member and the wall to a chanel-like drain means between the base member and the wall a sump drain to a central floor sump may be connected to the drain cove to drain the collected water from the drain means to the sump. The sump has a low profile and is comprised of horizontally disposed channels to provide a load bearing structure for personnel stepping thereon or to support the conventional basement furniture, appliances or the like.

3 Claims, 4 Drawing Figures

BASEMENT WATER DRAIN COVE

BACKGROUND OF THE INVENTION

It has been a problem in various basement structures to prevent wall seepage from one cause or another. Basement walls often seep and the moisture on the walls collect on the floors and causes physical damage and health problems. The uneveness and irregularities of conventional concrete or masonry walls presents a further problem in providing any drain means that might be attached to the wall and the floor to channel seep water to a disposal area.

SUMMARY OF THE INVENTION

By means of this instant invention there has been provided a strip-like extruded or molded cove or drain member which can be simply installed at the junction or corner of the basement floor and wall to drain seeping moisture from the wall along a channel or gutter means to a disposal area.

The drain cove has a foot-like base member which is adapted to be sealed to the floor adjacent the wall to provide a drain channel therebetween. In order to direct seeping moisture from the basement wall to the drain channel the drain cove has an upwardly extending cove member which has a downwardly extending portion bearing loosely against the basement wall to provide a gutter-like drain means to drain the water therein down the bottom of the wall to the drain channel where it is directed to a disposal means.

The drain cove may be conveniently made of rubber or plastic in strip-like form for easy installation by simply sealing by conventional adhesive or glue of the base member to the floor and butting the cove member against the wall. The drain cove is rugged and inexpensive and may be simply installed by professional constructors of the householder.

A sump drain for directing the collected water from the drain cove to a basement floor sump may also be used where such delivery to an avaiable floor sump is desired. The sump drain is also provided in strip-like form of rubber or plastic or the like and may simply be spliced into the drain cove and secured thereto by conventional adhesives or glue.

The sump drain has a low profile to avoid tripping by personnel using the basement and through a honeycomb like structure of horizontally disposed side by side passages provides strength and a means for directing the collected water from the drain cove to the sump.

The above features are objects of this invention. Further objects will appear in the detailed description which follows and will be otherwise apparent to those skilled in the art.

For the purpose of illustration of this invention a preferred embodiment is shown in the accompanying drawings. It is to be understood that the drawings are for purpose of example only and that the invention is not limited thereto.

IN THE DRAWINGS

DESCRIPTION OF THE INVENTION

Figure 1:
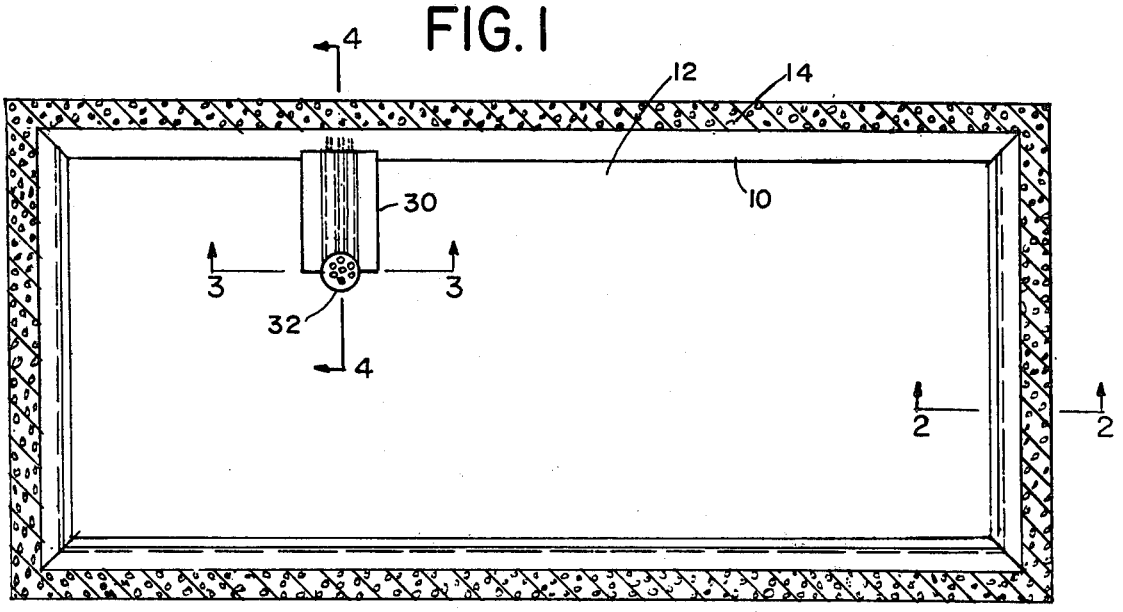
FIG. 1, is a top plan view of a basement wall provided with the drain cove of this invention.

The drain cove if generally indicated by the reference numeral 10 and is shown attached at the junction of a basement floor 12 and wall 14. The drain cove is comprised of a flat-like base member 16 secured to the floor and an upwardly extending cove member 18 loosely bearing against the wall.

Figure 2:
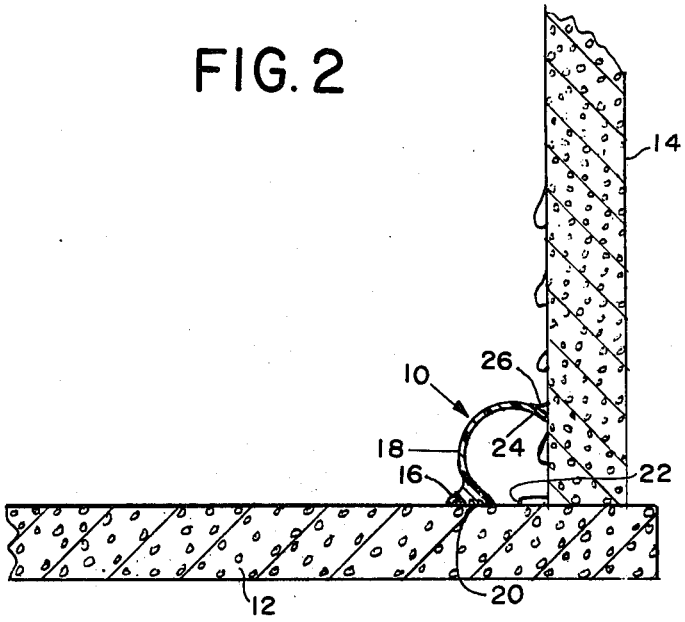
FIG. 2, is an enlarged view in vertical section taken on the line 2—2 of FIG. 1 showing the drain cove attached to the junction of a wall and floor.

The base member has a ribbed bottom surface 20 as best shown in FIG. 2 in order to facilitate securing of the base member to the floor by conventional glues or adhesives. In this manner the sealed base provides a drain channel 22 between the base member and the wall.

The cove member 18 extends upwardly above the base and has a downwardly extending water directing portion 24 which extends beyond the base member and bears loosely against the wall to define a gutter-like drain means 26. The loose bearing relationship of the cove member against the conventional irregularities in a concrete basement wall provides means for water collecting in the cove gutter 26 to drain downwardly along the wall to the floor channel drain means 22 while the depth of the gutter prevents overflowing and ensures that water does not flood onto the basement floor. While the cove member is shown of a semicircular configuration it will be understood that this structure may be varied as long as the downwardly directed cove portion is retained to form the gutter-like relationship against the wall.

The drain cove can be used to direct the drained water to any convenient disposal or drain along the basement wall. Where a central floor sump is provided spaced from the wall a specially devised sump drain 30 may be spliced into the drain cove to direct the water to the sump.

Figure 3:
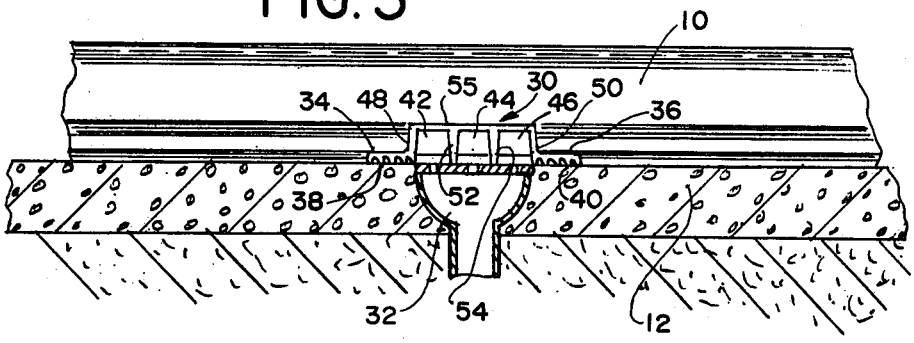
FIG. 3, is an enlarged view in section taken on the line 3—3 of FIG. 1.
Figure 4:
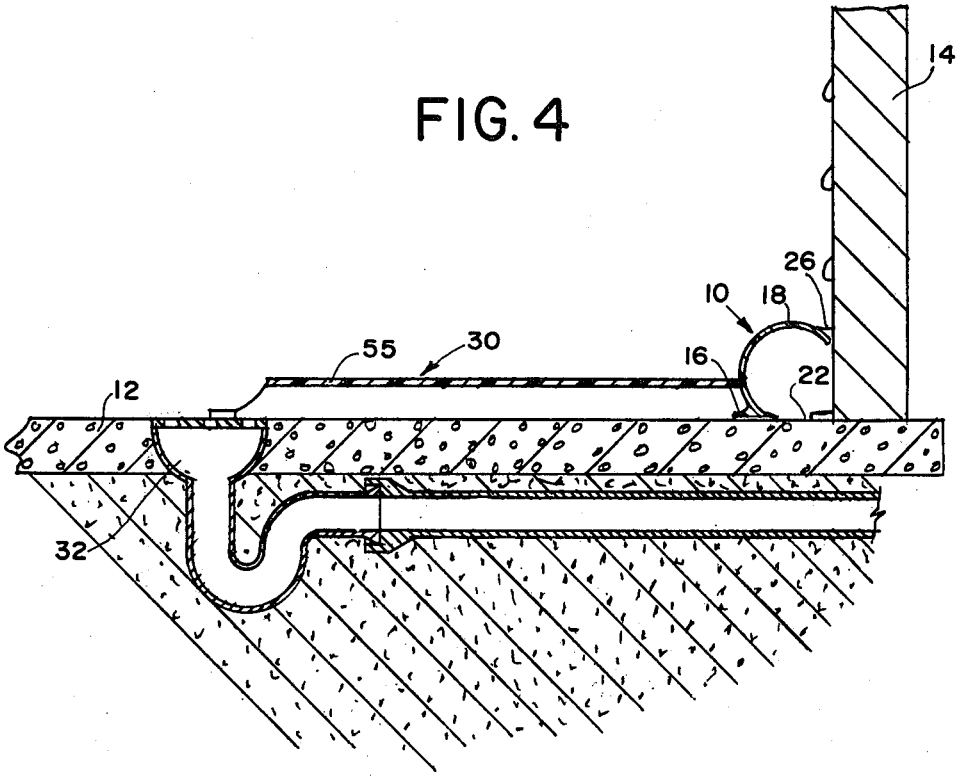
FIG. 4, is an enlarged view in section taken on the line 4—4 of FIG. 1.

The sump drain 30 is best shown in FIGS. 1, 3 and 4 connected between the drain cove and a floor sump 32. The sump drain is formed of rubber or plastic or the like in strip-like form of low profile.

In order to provide a means for sealing the sump drain to the floor flanges 34 and 36 extend on both sides of the drain and are provided with ribbed bottom surfaces 38 and 40 to facilitate sealing by glue, adhesive or the like. Multi-channels 42, 44 and 46 defined by end walls 48 and 50 and intermediate walls 52 and 54 are open at the bottom and direct the drained water to the sump. A top wall 55 is connected to the end and intermediate walls to provide a load bearing surface strengthened by the aforementioned end and intermediate wall construction as in a honey-comb structure.

The sump drain may be simply cut and interfitted with the drain cove to form a spliced connection as shown in FIGS. 1 and 4 and connected by the aforementioned glue, adhesive or the like.

USE

The drain cove is simply installed by cutting to size, butting against the wall and sealing the base member by glue or adhesive to the basement floor. The drain cove will then receive any moisture seeping or dripping along the wall and first collect any water in the cove gutter 26 that does not drain between the cove member downwardly directed portion 24 and the basement wall. Any water collected in the gutter will in due course find its way because of irregularities in the wall finish down to the floor drain channel 22 where it is directed to disposal. It will also be understood that where necessary or desirable if the wall surface irregularities are insufficient for draining irregularities such as scallop shaped openings or the like in the edge of the cove member bearing against the wall may be provided.

Where it is desired to drain the cove member to a floor sump the sump drain 30 is simply installed. In this installation one end of the sump drain is simply spliced into the cove member and sealed thereto. The sump drain is further sealed to the floor at the flanges with the free end directed to the sump.

Through the low profile of the sump drain and the multi-channel honey-comb type of construction a load bearing structure is provided that personnel using the basement can step on without tripping or causing damage. Likewise, the usual basement furniture and appliances may be positioned on the drain without damage thereto.

Various changes and modifications may be made in the invention as will be readily apparent to those skilled in the art. Such changes and modifications are within the scope and teaching of this invention as defined by the claims appended hereto.

What is claimed is:

1. A unitary integral plastic or rubber-like drain cove of uniform composition for draining water from a basement wall along a junction of the wall and floor which comprises a base member secured in sealed relation on the floor adjacent to and spaced from said wall to define a drain channel bounded by the wall, the floor and said base member and a water directing cove member integrally connected to said base member extending upwardly from and inwardly of said base and having a water directing portion at a top part of the cove member extending downwardly toward and bearing lightly against the wall and being free of any connection thereto to provide water drain means for moisture on said wall surfaces to said drain channel, said base member extending outwardly along the floor from a bottom portion of the cove member, said water directing portion being constructed of a plastic or rubber-like material having the capacity to conform to irregularities in the wall surface against which it bears and extending from a point above and inwardly from said base member and spaced from said wall downwardly toward and against said wall to provide a gutter defining said water drain means and said base member being spaced from said wall and secured to the floor outwardly of said water directing portion.

2. The drain cove of claim 1 in which said base member has a flat longitudinally ribbed bottom to facilitate gripping the floor and sealing by an adhesive to said floor.

3. The drain cove of claim 1 in which a sump drain is supported on the basement floor and is connected to said drain cove and a sump in the basement floor, said sump drain being of an integral construction of plastic or rubber-like material comprised of a plurality of laterally disposed channels defined by vertically extending load bearing partition walls, said sump drain having a load bearing top wall and a low shallow profile with a relatively short height and a width substantially greater than said height, said sump drain being further provided with laterally extending flanges flush with the bottom of said partition walls sealed to said basement floor.

* * * * *